United States Patent [19]

Itoh et al.

[11] Patent Number: 4,644,973

[45] Date of Patent: Feb. 24, 1987

[54] VALVE UNIT FOR AIR-CONDITIONER PIPING

[75] Inventors: Nobuaki Itoh; Takashi Sekine, both of Hiratsuka, Japan

[73] Assignee: Yokohama Aeroquip Company, Tokyo, Japan

[21] Appl. No.: 782,368

[22] Filed: Oct. 1, 1985

[30] Foreign Application Priority Data

Oct. 3, 1984 [JP] Japan ..... 59-149079

[51] Int. Cl.[4] ..... F16K 11/044

[52] U.S. Cl. ..... 137/883; 137/866; 251/214; 62/292

[58] Field of Search ..... 137/883, 318, 866; 251/214, 216; 62/292

[56] References Cited

U.S. PATENT DOCUMENTS

| | | | |
|---|---|---|---|
| 1,924,007 | 8/1933 | Weatherhead, Jr. | 62/292 |
| 3,424,181 | 1/1969 | Morse | 62/292 X |
| 3,916,947 | 11/1975 | Holmes et al. | 62/292 X |
| 3,978,881 | 9/1976 | Mouranie | 137/318 |

FOREIGN PATENT DOCUMENTS

| | | | |
|---|---|---|---|
| 1224818 | 2/1962 | France | 137/318 |
| 2321652 | 3/1977 | France | 137/318 |
| 50094 | 12/1978 | Japan . | |
| 26770 | 6/1980 | Japan . | |
| 8225 | 3/1985 | Japan . | |
| 1428477 | 3/1977 | United Kingdom | 137/318 |

*Primary Examiner*—A. Michael Chambers
*Assistant Examiner*—John C. Fox
*Attorney, Agent, or Firm*—Brumbaugh, Graves, Donohue & Raymond

[57] ABSTRACT

In a valve unit provided with a straight-cylindrical valve housing having a thick barrel portion and a thin head portion; an inward-facing valve seat on the upper edge of the head portion; and an upper edge on the head of an internal valve element, the upper edge engages the inward-facing valve seat when a lower passage in the valve housing is defined.

1 Claim, 7 Drawing Figures

VALVE UNIT FOR AIR-CONDITIONER PIPING

BACKGROUND OF THE INVENTION

The present invention relates to an improvement in valve units used in the piping of a split type of air-conditioner suitable for a residential chamber.

Such an air-conditioner comprises an indoor unit and an outdoor unit interconnected by a high-pressure-side pipe and a low-pressure-side pipe. Three-way valves are normally used, as shown in FIG. 6A, to connect a high-pressure-side conduit $l_1$ and a low-pressure-side conduit $l_2$ extending from a heat exchanger $b_1$ of the indoor unit $a_1$, to a heat exchanger $b_2$ or a compressor c of the outdoor unit $a_2$, to install the air conditioner; and this is used in the operation of the compressor to charge refrigerant and also to recover refrigerant from the indoor unit $a_1$ into the outdoor unit $a_2$ for the purpose of repositioning the air conditioner.

The conventional three-way valve v, shown in FIG. 6B, comprises an upper body 1 and a lower body 2. The upper body 1 includes a valve rod holder 1*a* having a longitudinal bore with internal threads, a sub-adapter 1*c* having a lateral through-hole as a charging inlet for refrigerant, and a main adapter 1*b* having a lateral through-hole which communicates through an enlarged chamber 1*d* with the other lateral through-hole in a different level. The lower body 2 is in a cock-like form and provided with a longitudinal bore in alignment with the longitudinal bore in the holder 1*a* and the enlarged chamber 1*d*, and a lateral bore into which a short pipe 2*a* is fitted for connection to the compressor. A valve rod 3 is threadedly received into the holder 1*a* and is provided at its lower end with a valve element 3*a* which has the shape of two truncated cones and is positioned in the enlarged chamber 1*d*. The holder 1*a* and the sub-adapter 1*c* are covered by caps 4*a* and 4*b*, respectively.

When the air conditioner is in operation, the valve rod 3 is moved upwards to shut off the longitudinal bore in the upper body by engagement with the upper surface of the valve element 3*a*; and, when the air conditioner is being transported, the valve rod 3 is moved downwards to shut off the longitudinal bore in the lower body 2 by engagement with the lower surface of the valve element 3*a*.

As described above, since the conventional three-way valve uses a method of switching refrigerant passages in the middle of the body of the valve unit by engagement of the upper and lower surfaces of the valve element therewith, an enlarged chamber is required for the valve. Accordingly, for technical reasons, the body of the valve unit must be constituted by two separate parts, that is, the upper and lower bodies 1 and 2 instead of one continuous body and is constructed such that after the valve rod 3 is fitted into the upper body 1 and the head portion of the lower body 2 is inserted into an opening of the upper body 1, the junction between these two bodies is brazed and then washed. This process is labor-consuming and expensive, and sometimes results in a misalignment of the longitudinal bores in the upper and lower bodies 1 and 2 which makes the valve element 3*a* malfunction in the partitioning thereof. Additionally, the manifold-like upper body 1 and the cock-like lower body 2 are mainly formed in a rather inefficient forging manner, because the cutting of such parts would waste a considerable amount of material. This also results in increased cost of manufacturing the body of the valve unit of this kind.

SUMMARY OF THE INVENTION

Accordingly, the object of the present invention is to provide a low-cost valve unit for an air conditioner which can be easily made by machining without wasting material thereof and which provides a sure shutting-off operation. The valve unit according to the present invention comprises a cylindrical valve housing including a thick barrel portion and a thin head portion and a longitudinal bore extending therethrough, an adapter for connection of a conduit, another refrigerant-charging adapter having a valve core located therein the adapters being positioned on opposite sides of the barrel portion; a short pipe secured to the lower end of the barrel portion; an inward-facing valve seat formed on the upper end of the head portion; a cap detachably fitted to the head portion at its outer periphery; and a rodlike valve element threaded into the longitudinal bore in the valve housing and having at its lower end an oblique surface capable of engaging a lower valve seat of the longitudinal bore, the valve element having its peripheral edge engaging the inward facing valve seat on the head of the valve housing when a retrigerant passage is defined between the adapter for connection of the conduit and the short pipe.

When the valve element is in its upper position, a passage is defined between the adapter for connection of a conduit and the short pipe connecting with an outdoor unit, and the refrigerant circulates through a closed circuit in the air conditioner. During this time, the peripheral edge on the upper end of the valve element engages the inward-facing valve seat to prevent leakage of the circulating refrigerant from the upper portion of the valve housing. When the valve element is moved downwards to press the lower oblique surface against the lower seat of the longitudinal bore, the passage for the refrigerant is shut off so as to enable the air conditioner to be transported.

DESCRIPTION OF THE PREFERRED EMBODIMENT

Figure 1:
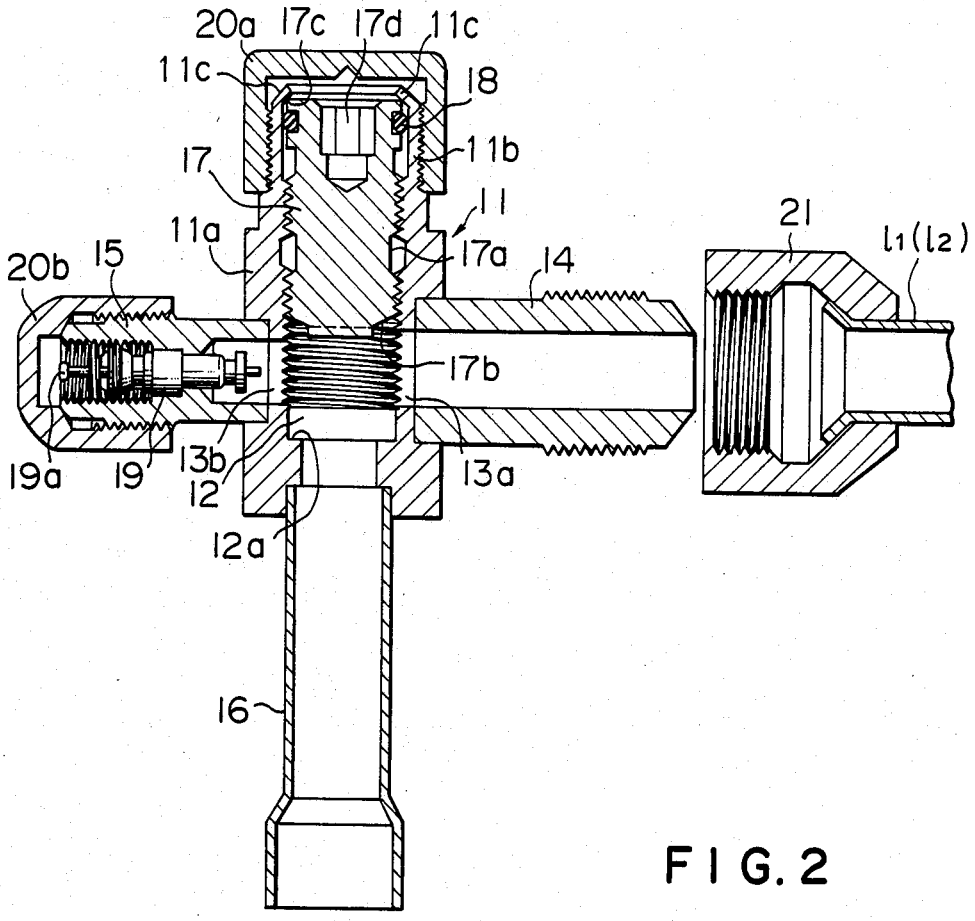
FIG. 1 is a cross-sectional view of the valve unit according to the invention.

FIG. 1 shows a valve unit according to the present invention and comprising a cylindrical valve housing 11 including a thick barrel portion 11*a* and a head portion 11*b*, and a longitudinal bore 12 extending therethrough. The barrel portion 11*a* is provided with right and left lateral bores 13*a* and 13*b* formed therein at the same level and intersecting with the longitudinal bore 12 in the barrel portion. An adapter 14 for connection of a conduit and an adapter 15 defining a charging inlet for refrigerant are inserted into and fixed to the right and left bores 13*a* and 13*b*, respectively. A short pipe 16 is inserted into and fixed to the lower end of the barrel portion to connect a heat exchanger or compressor in an outdoor unit. Threads are formed around the outer periphery of the head portion 11*b* which has the upper brim inwardly and obliquely contracted to form a valve seat 11*c* coaxial with the longitudinal bore 12 and a lower valve seat 12*a*. The contracted upper brim also serves as a stop for preventing a valve element 17 from slipping out, which will be described below.

Figure 2:
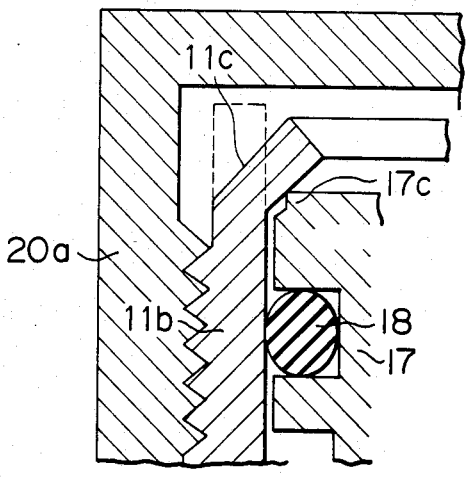
FIG. 2 is a cross-sectional view of part of the head portion of the valve casing thereof.

Internal threads are provided on the inner surface of the longitudinal bore 12 has internal threads formed therein at the center of the barrel portion and at the base of the head portion. A rodlike valve element 17 is provided with an annular recess 17*a* around a middle portion thereof and screwed into these threads. On the lower end of the valve element 17, there is provided an inwardly inclined surface 17*b* which comes into contact with a lower valve seat 12*a* defined by the small diameter portion of the bore 12. In the middle of the upper end of the valve element, there is provided a hexagonal hole 17*d* into which a wrench can be received to rotate the valve element. An annular inward step is formed around the valve element at its upper end to define a sharp upper peripheral edge 17*c*, as shown in FIG. 2, which, when the valve is moved upward, engages the inward-facing valve seat 11*c* of the head portion 11*b* of the valve housing to prevent the internal refrigerant from flowing out, in cooperation with an O-ring 18 fitted around the valve element below the edge.

Threadedly received inside the adapter 15 serving as a charging inlet for refrigerant is a valve core 19 including an outer cylinder and a spring-loaded valve rod 19*a* extending centrally through the valve core and having at its lower end a valve element 19*b* cooperating with the lower end of the outer cylinder. The interior of the valve core will be communicated with the lateral bore 13*b* of the valve case 11 by disengagement of the valve element from the lower end of the outer cylinder when the valve rod 19*a* is pushed on the top end thereof. The head portion 11*b* of the valve housing and the adapter 15 are detachably covered by caps 20*a* and 20*b*, respectively.

Figure 3:
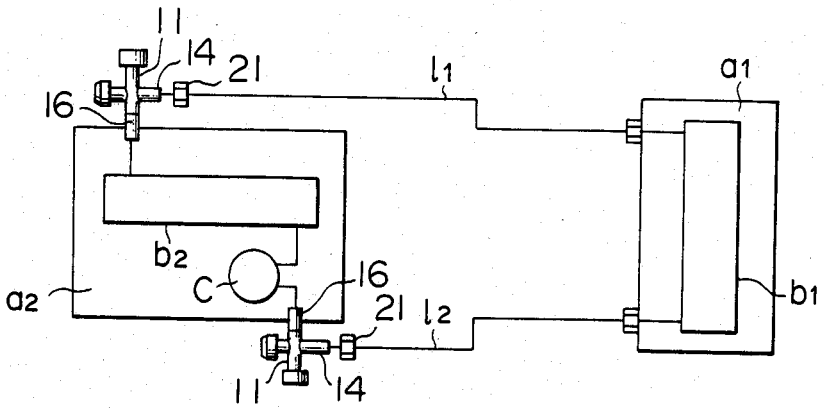
FIG. 3 is a diagram of the piping in which the valve unit is used.
Figure 4:
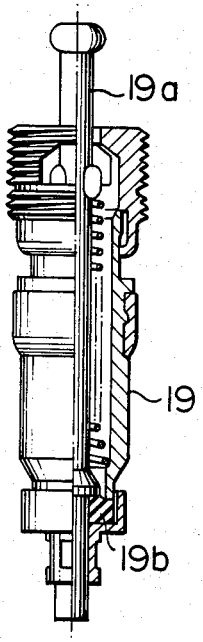
FIG. 4 is a partially-sectioned side elevation of the valve core.

In use, these valve units are connected to the outdoor heat exchanger $b_2$ and the compressor c by their short pipes 16, and the adapter 14 of one of the valve units connected to the heat exchanger $b_2$ and the adapter 14 of the other valve unit connected to the compressor c are connected to a conduit $l_1$ on te high-pressure side and a conduit $l_2$ on the low-pressure side by means of box nuts 21, respectively (see FIG. 3).

Thus, when the rodlike valve element 17 in the valve housing 11 of each of the valve units positioned upwards, as shown in FIG. 1, and the passage between the adapter 14 for connecting the conduit and the short pipe 16 defined, the compressor is operated to circulate the refrigerant through the conduits $l_1$ and $l_2$, so that the chamber is cooled as desired.

During the operation, the inner passage of the adapter 15 for charging the refrigerant is shut off by the valve core 19 in its closed position, and the sharp upper peripheral edge 17*c* of the valve 17 engages the inward-facing valve seat 11*c* on the upper end of the longitudinal bore 12. Thus, the circulating refrigerant does not leak out.

When the air-conditioner is to be transported, the valve element 17 in the valve housing 11 on the low-pressure side is positioned so as to remain open, and the valve element 17 on the high-pressure side is lowered so that the oblique surface of the lower end thereof, is pressed against the lower valve seat 12*a* of the longitudinal bore 12 to shut off the passage. The compressor c is operated to recover the refrigerant to the outdoor unit $a_2$ from the indoor unit $a_1$ and the conduits $l_2$, and $l_2$, and then the valve element 17 on the low-pressure side is lowered to shut off the refrigerant passage. Finally the conduit $l_1$, or $l_2$ is detached from the corresponding adapter 14 by removing the box nuts 21.

When the apparatus is installed, the conduit $l_1$ or $l_2$ is connected to the corresponding adapter 14 of the valve units, both the valve element 17 on the high-pressure and low-pressure sides remaining shut. Then, the valve element 17 on the high-pressure side is opened when the valve element 17 on the low-pressure side is kept shut, so that the refrigerant gas recovered in the outdoor unit $a_2$ flows through the high-pressure side conduit $l_1$, the indoor unit $a_1$ and the low-pressure side conduit $l_2$ into the valve housing on the low-pressure side, thereby flowing through a space around the annular recess 17*a* of the valve element 17 into the adapter 15 for charging the refrigerant.

The valve rod 19*a* in the valve core inserted in the adapter 15 is pushed to expel any air in the conduits $l_1$ and $l_2$ and in the indoor unit $a_1$. In this way, the closed path of the apparatus is charged with refrigerant ready for operation. (When the air conditioner is to be used, the valve element on the low-pressure side is opened).

When the apparatus is charged with the refrigerant, the valve elements 17 on the high-pressure and low-pressure sides are kept open, and a cylinder containing refrigerant therein is connected at its outlet to the adapter 15 of the valve housing 11 on the low-pressure side to push the valve element 19*a* away from the end of the outer cylinder of the valve core. The compressor then operates to charge the apparatus with refrigerant.

Figure 5:
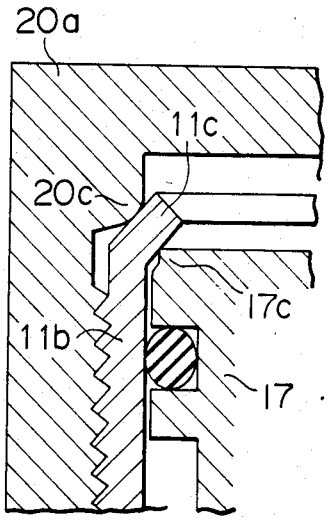
FIG. 5 is a cross-sectional view of part of the head portion of the valve housing in an alternative embodiment.
Figure 6A:
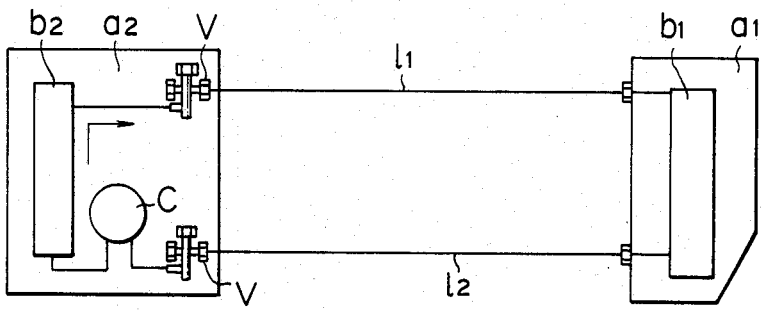
FIG. 6A PRIOR ART
FIG. 6A is a diagram showing the piping of a conventional air conditioner.
Figure 6B:
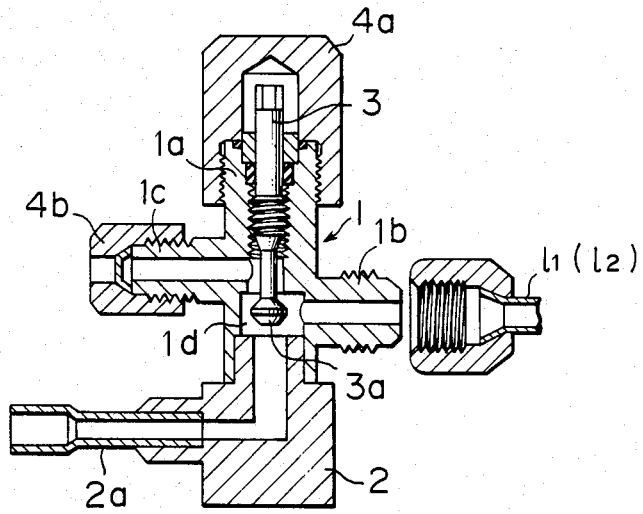
FIG. 6B PRIOR ART
FIG. 6B is a cross-sectional view of a valve in FIG. 6A.

FIG. 5 shows an alternative arrangement, in which an inward annular protrusion 20*c* is provided around the inner bottom surface of the cap 20*a* covering the head portion 11*b* of the valve housing, so that the inward annular protrusion is pressed against the valve seat 11*c* on the upper end of the valve housing 11 when the sharp edge 17*c* on the upper end of the valve 17 is engaged with the valve seat 11*c*, when the refrigerant passage is open in the valve housing. The valve seat 11*c* is nipped between the edge 17*c* of the valve element 17 and the annular protrusion 20*c*. This arrangement provides a stronger seal in the head portion of the valve housing.

As described above, according to the present invention, a valve unit for an air-conditioner is provided with a straight-cylindrical valve housing formed by a thick barrel portion and a thin head portion, an inward valve seat on the upper end of the head portion, and a edge on the upper end of an internal valve element. This edge engages the inward valve seat of the valve housing when a refrigerant passage is defined, so as to prevent the refrigerant from flowing out. Accordingly, since it is not necessary to divide this valve into two parts for the purpose of forming an enlarged chamber in the middle of the valve housing, as in the conventional art, the valve housing can be readily made from a round bar by cutting works without wasting material and can be efficiently produced at a low cost. Furthermore, the upper and lower valve seats are coaxially aligned without an possibility of misalignment. This enables the valve housing to be partitioned surely and prevents any leakage of refrigerant.

What is claimed is:

1. A valve unit for the piping of an air-conditioner, comprising a valve housing (11) including a lower thick barrel portion (11*a*) and an upper thin head portion (11*b*), a straight-cylindrical longitudinal bore (12) extending therethrough, an adapter (14) for connection of a conduit, another adapter (15) serving as a charging inlet for a refrigerant and having valve core (19) therein, said adapters being located on opposite sides of said barrel portion; a short pipe (16) attached to the lower end of said barrel portion (11*a*); an inward-facing valve seat (11*c*) formed on the upper end of said head portion (11*b*); a rodlike valve element (17) having an annular recess (17*a*) around a middle portion thereof and screwed into said valve housing (11); and a cap (20*a*) detachably fitted to said head portion (11*b*) and having an inward annular protrusion (20*c*) around an inner bottom surface therein covering said head portion (11*b*) of said valve housing (11), said inward-facing valve seat being arranged to be (11*c*) nipped between said inward annular protrusion (20*c*) and said edge (17*c*) of said valve element (17); said rodlike valve element (17) having at its lower end an oblique surface (17*b*) capable of being brought into contact with a lower valve seat (12*a*) of said longitudinal bore (12) and at its upper end an upper edge (17*c*) adapted to be brought into engagement with said inward facing valve seat (11*c*) on the upper end of said head portion (11*b*) to define a refrigerant passage.

* * * * *